United States Patent [19]

Nakayama et al.

[11] Patent Number: 4,736,201

[45] Date of Patent: Apr. 5, 1988

[54] HIGH SPEED IMAGE DRAWING METHOD AND APPARATUS THEREFOR

[75] Inventors: Yoshiyuki Nakayama; Akio Hayashi, both of Yokohama; Junichi Seki, Hitachi; Kenjiro Mori, Yokohama, all of Japan

[73] Assignee: Hitachi, Ltd., Tokyo, Japan

[21] Appl. No.: 827,608

[22] Filed: Feb. 10, 1986

[30] Foreign Application Priority Data

Feb. 8, 1985 [JP] Japan ..... 60-21633

[51] Int. Cl.[4] ..... G09G 1/14

[52] U.S. Cl. ..... 340/747; 340/744; 340/723; 340/728; 364/719; 364/720

[58] Field of Search ..... 340/747, 723, 728, 744; 364/719, 720, 721, 731

[56] References Cited

U.S. PATENT DOCUMENTS

| | | | |
|---|---|---|---|
| 3,789,200 | 1/1974 | Childress et al. | 340/747 |
| 3,917,932 | 11/1975 | Saita et al. | 364/720 |
| 4,023,027 | 5/1977 | Strathman et al. | 364/719 |
| 4,272,808 | 6/1981 | Hartwig | 364/719 |
| 4,371,933 | 2/1983 | Bresenham et al. | 364/720 |
| 4,425,559 | 1/1984 | Sherman | 340/747 |
| 4,434,437 | 2/1984 | Strolle et al. | 364/731 |
| 4,458,330 | 7/1984 | Imsand et al. | 340/747 |

OTHER PUBLICATIONS

"An Improved Algorithm for the Generation of Non-parametric Curves", IEEE Transactions on Computers, vol. C-22, #12, Dec. 1973, Jordan, Jr. et al.

*Primary Examiner*—Gerald L. Brigance

*Attorney, Agent, or Firm*—Antonelli, Terry & Wands

[57] ABSTRACT

The tangent $\alpha$ of the tangential line of an image to be drawn at each point in an orthogonal X−Y coordinate system is classified into two angle regions, a first angle region, where a condition $-1 \leqq \alpha < 1$ is fulfilled, and a second angle region, where a condition $\alpha < -1$ or $1 \leqq \alpha$ is fulfilled. The first and the second angle region is represented by the direction parallel to the X-axis and the direction parallel to the Y-axis, respectively. When the image to be drawn is displayed on a display screen, in the image to be drawn, the parts belonging to the first angle region are drawn with a plurality of segments, each of which is parallel to the X-axis, and the parts blonging to the second angle region are drawn with a plurality of segments, each of which is parallel to the Y-axis. That is, the image to be drawn is displayed on the display screen by using only segments parallel to the X-axis and those parallel to the Y-axis.

6 Claims, 14 Drawing Sheets

HIGH SPEED IMAGE DRAWING METHOD AND APPARATUS THEREFOR

BACKGROUND OF THE INVENTION

This invention relates to a high speed image drawing method permitting the drawing of an image including curves in an image output region at a high speed and with a visually more natural appearance, and to an apparatus for realizing the method.

In the case where a raster scan type CRT display is used as a graphic terminal for a computer system, it is usual to draw an image on the screen by illuminating selectively desired pixels on the screen, in the case of an image output region composed of a plurality of pixels arranged in a matrix form. Further, a plasma display or a display consisting of light emitting diodes arranged in a matrix form is a typical image output apparatus constituted by pixels arranged in a matrix form, for each of which a light emitting element operates as a pixel.

When a desired image is drawn on such an image output apparatus composed of pixels arranged in a matrix form, any image drawn in the image output region cannot be represented by a smooth curve. For example, when the image to be drawn is an ellipse 1 as indicated in FIG. 1A, the image 3 actually drawn in the image output region composed of pixels arranged in a matrix is an approximate image composed of a set of segments, as indicated by 2 in FIG. 1B.

Heretofore, in the case where an image was displayed in an image output region composed of pixels arranged in a matrix form, since pixels to be illuminated were selected by calculating for each of the pixels which was the closest pixel in the image output region to the image to be drawn, the time necessary for the drawing was long. For example, as seen in FIG. 2 suppose that it is to be determined which pixel after a pixel $P_o$ is to be illuminated, when an image S represented by a function $F(x, y)=0$ is being drawn in the direction indicated by the arrow. According to one of the methods proposed heretofore, at first 8 pixels $P_1, P_2, \ldots, P_8$ adjacent to the pixel $P_o$ in the up and down directions, and right and left directions are selected as candidates for the pixel which is to be illuminated next. Then the pixels $P_4, \ldots, P_8$ are excluded, by considering the inclination of the image S to be drawn and the direction of the advance of the drawing. After that, for each of the remaining 3 candidate pixels $P_1$, $P_2$ and $P_3$, the distance therefrom to the image S to be drawn, which is represented by the function $F(x, y)=0$, is calculated and the pixel having the smallest distance is selected as the pixel, which is to be illuminated next. Since a number of calculations should be repeated for each of the pixels in this way, a long time is necessary for producing the drawing in this way.

Further, according to the prior art method described above, since the pixel to be illuminated was determined only on the basis of calculation results, sometimes visually unnatural parts appeared in the image drawn in the image output region or on the display screen. For example, according to the prior art method, it happened that the pixels indicated in FIG. 3A were selected so as to be illuminated for the image to be drawn. However, when an observer looks at the image screen, on which such an image is drawn, since the part indicated by Q in FIG. 3A has a higher pixel density than the others, it looks like a protuberance-like lump attached on a curve so that the observer finds it ugly. It was found that if the pixels to be illuminated are selected as indicated in FIG. 3B for the same image as that for FIG. 3A, the observer finds it more natural.

SUMMARY OF THE INVENTION

This invention is directed to solution of the problematical points of the prior art, as described above, and its object is to provide a high speed image drawing method which makes it possible to draw an image including curves in an image output region at a high speed and with a visually more natural appearance, and an apparatus for realizing it.

This invention is characterized in that when segments are drawn in the image output region, the direction of the drawing is restricted to several predetermined drawing directions (e.g. 2 directions, i.e. X- and Y-axis directions in an orthogonal X-Y coordinate system), that a segment is drawn while selecting one of the predetermined directions, depending on the inclination of the tangent of the image to be drawn at each point and that the image is drawn by repeating this procedure. In this specification, a segment consisting only of one pixel is also referred to as a segment.

DESCRIPTION OF THE PREFERRED EMBODIMENTS

Figure 1A:
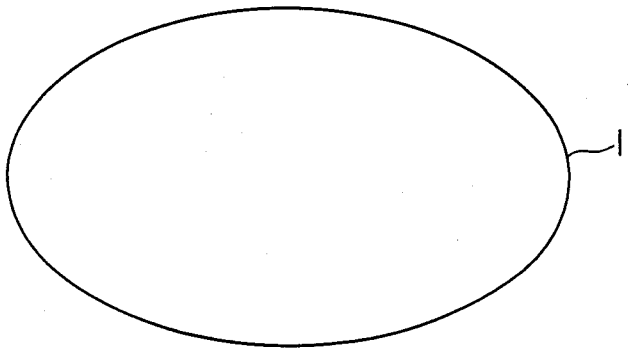
FIGS. 1A and 1B are schematic diagrams for explaining the difference between an image to be drawn and an image which is actually drawn in the image output region.
Figure 1B:
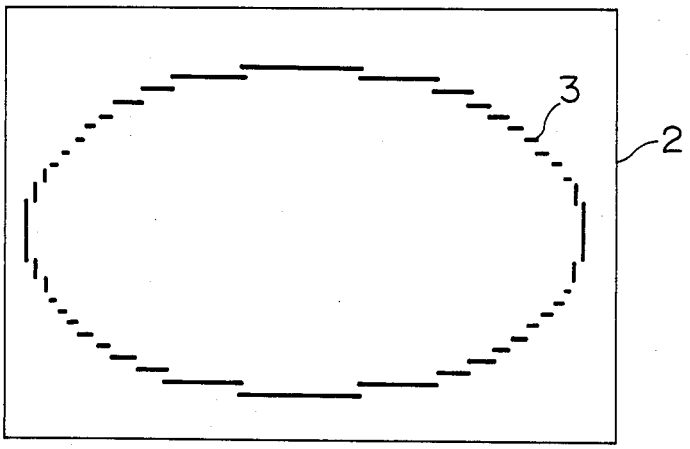
Figure 2:
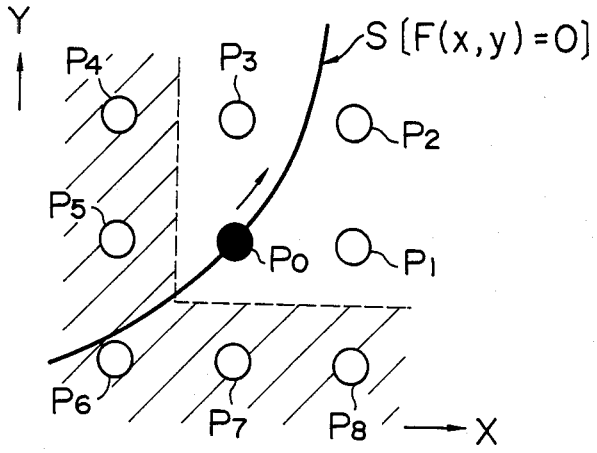
FIG. 2 PRIOR ART
FIG. 2 is a schematic diagram for explaining a prior art drawing method.

Hereinbelow some preferred embodiments of this invention will be explained, referring to the drawings.

Figure 4:
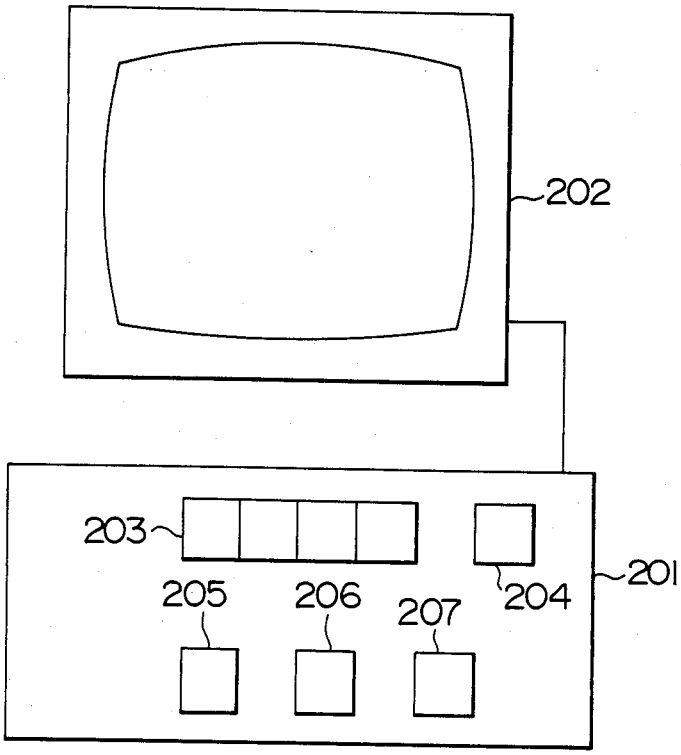
FIG. 4 is a schematical view illustrating a display device used for realizing this invention.

FIG. 4 illustrates the outline of a display device, which is an embodiment of this invention. As indicated in the figure, the display device comprises a key board 201 and a CRT display portion 202, and a cursor shifting key 203, a cursor position coordinate input key 204, a straight line drawing command key 205, an ellipse drawing command key 206 and a circle drawing command key 207 are disposed on the key board 201.

Figure 5A:
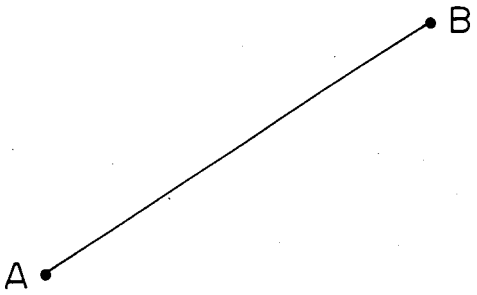
FIGS. 5A, 5B and 5C shows three different images to be drawn by using the display device illustrated in FIG. 4.

In the case where a straight line as indicated in FIG. 5A is to be drawn, at first the straight line drawing command key 205 is pushed. Then, the cursor is set at the position A corresponding to an end of the straight line on the CRT display portion 202 by using the cursor shifting key 203 and the cursor position coordinate input key 204 is pushed. Further, the cursor is set at the position B corresponding to the other end of the straight line and the cursor position coordinate input key 204 is pushed. The desired straight line is displayed by the procedure described above.

Figure 5B:
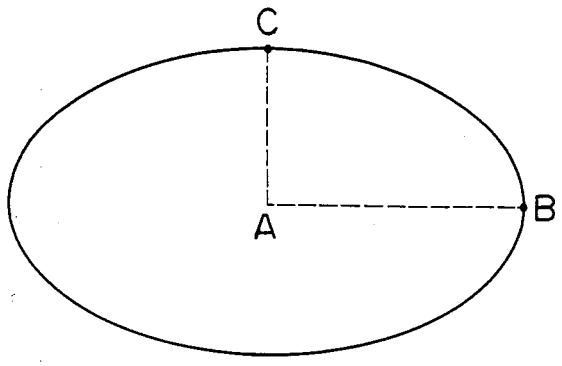

Next, in the case where an ellipse as indicated in FIG. 5B is to be drawn, at first the ellipe drawing command key 206 is pushed. Then, the cursor is set at the position A corresponding to the center of the ellipse on the CRT display portion 202 by using the cursor shifting key 203 and the cursor position coordinate input key 204 is pushed. Further, the cursor is set at a position B, which is spaced from the center of the ellipse by the length of the major axis, by using the cursor shifting key 203 and the cursor position coordinate input key 204 is pushed. After that, the cursor is set at a position C, which is spaced from the center of the ellipse by the length of the minor axis, by using the cursor shifting key 203 and the cursor position coordinate input key 204 is pushed. By the procedure described above, the ellipse is displayed.

Figure 5C:
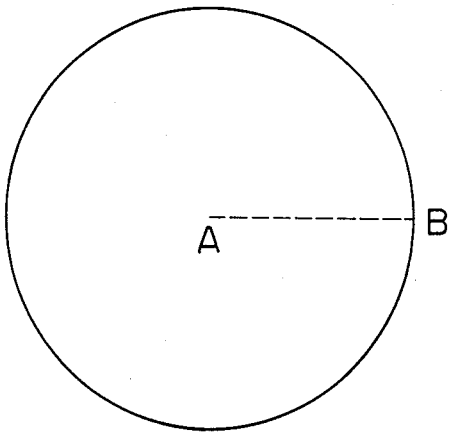

In order to display a circle as indicated in FIG. 5C, the circle drawing command key 207 is pushed. Then, the cursor is set at a position A corresponding to the center of the circle and the cursor position coordinate input key 204 is pushed. Further, the cursor is set at a position B, which is apart from the center of the circle by the length of the radius and the cursor position coordinate input key 204 is pushed. By the procedure described above, the circle is displayed.

Figure 6:
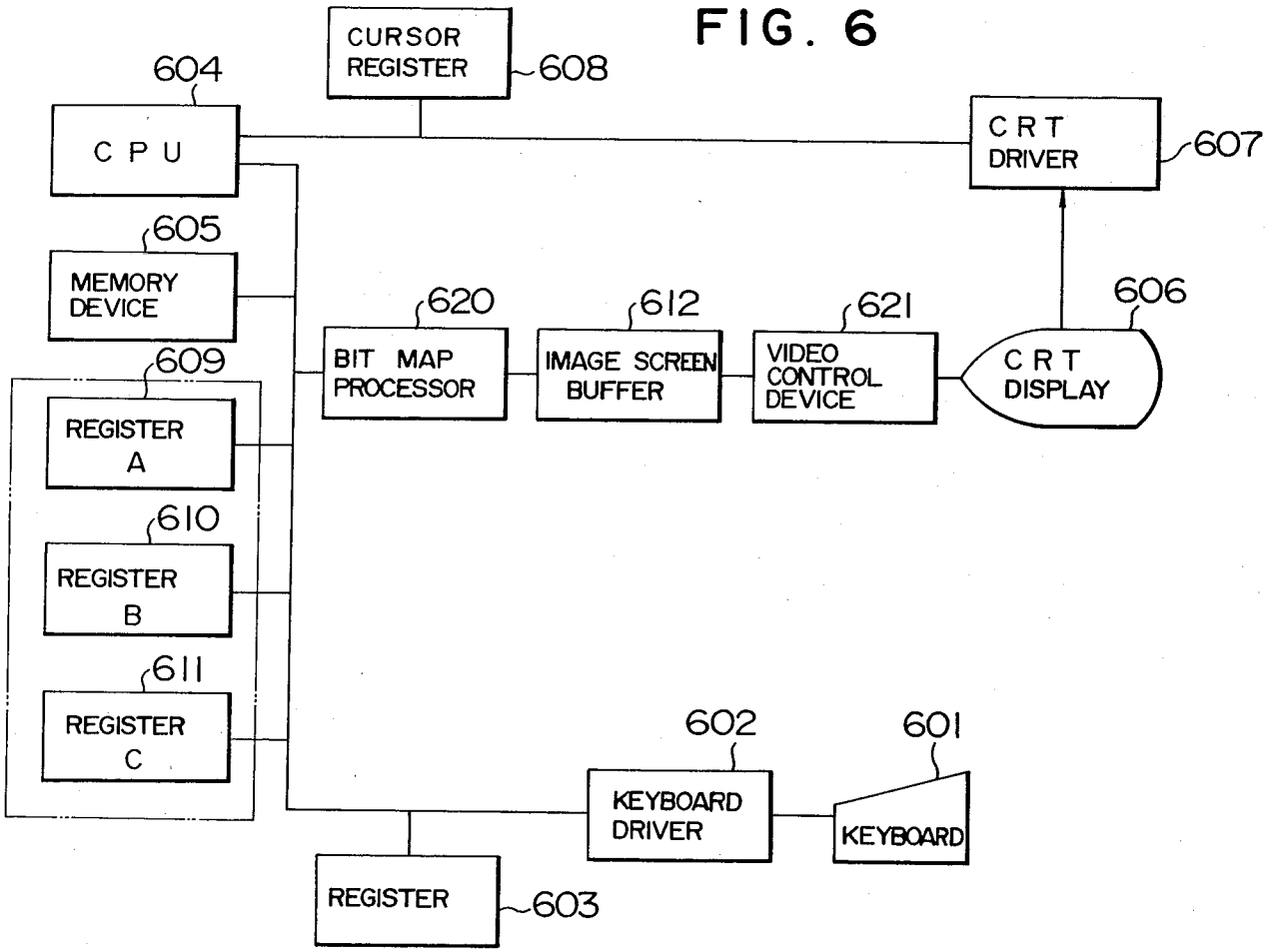
FIG. 6 is a block diagram indicating a concrete example of the construction of the display device illustrated in FIG. 4.

FIG. 6 is a block diagram indicating an example of devices for realizing the high speed drawing method according to this invention. When either one of the straight line drawing command key 205, the ellipse drawing command key 206 and the circle drawing command key 207 disposed on the key boards 601 is pushed, a code is produced by a keyboard driver 602, which code is stored in a register 603 and a CPU 604 starts the program in a memory device 605. Registers 609, 610 and 611 constitute a group of registers for storing parameters of the image to be drawn. The cursor position information in the CRT display portion 606 is stored in a cursor register 608 by a CRT driver 607.

In the case where the pushed key is the straight line drawing command key 205, when the cursor position coordinate input key 204 is pushed, the CPU 604 stores the coordinates of the position of an end of the straight line from the cursor register 608 where the position of the cursor is stored in the register A 609 and those coordinates of the other end in the register B 610. After that, it effects processing to write the straight line on an image screen buffer. Since each of the memory cell positions in the image screen buffer 612 corresponds to each of the pixels on the image screen of the CRT display device, e.g. when "1" is written in a memory cell position in the image screen buffer 612, the pixel on the image screen of the CRT display device corresponding to the memory cell position is illuminated.

In the case where the pushed key is the ellipse drawing command key 206, when the cursor position coordinate input key 204 is pushed, the CPU 604 stores the coordinates of the position of the center of the ellipse in the register A 609, the length of the major axis in the register B 610 and the length of the minor axis in the register C 611 from the cursor register 608 where the position of the cursor is stored. After that, it effects processing to write the ellipse on the image screen buffer.

In the case where the pushed key is the circle drawing command key 207, when the cursor position coordinate input key 204 is pushed, the CPU 604 stores the coordinates of the position of the center of the circle in the register A 609 and the length of the radius in the register B 610 from the cursor register 608 where the position of the cursor is stored. After that, it effects processing to write the circle on the image screen buffer.

Figure 7:
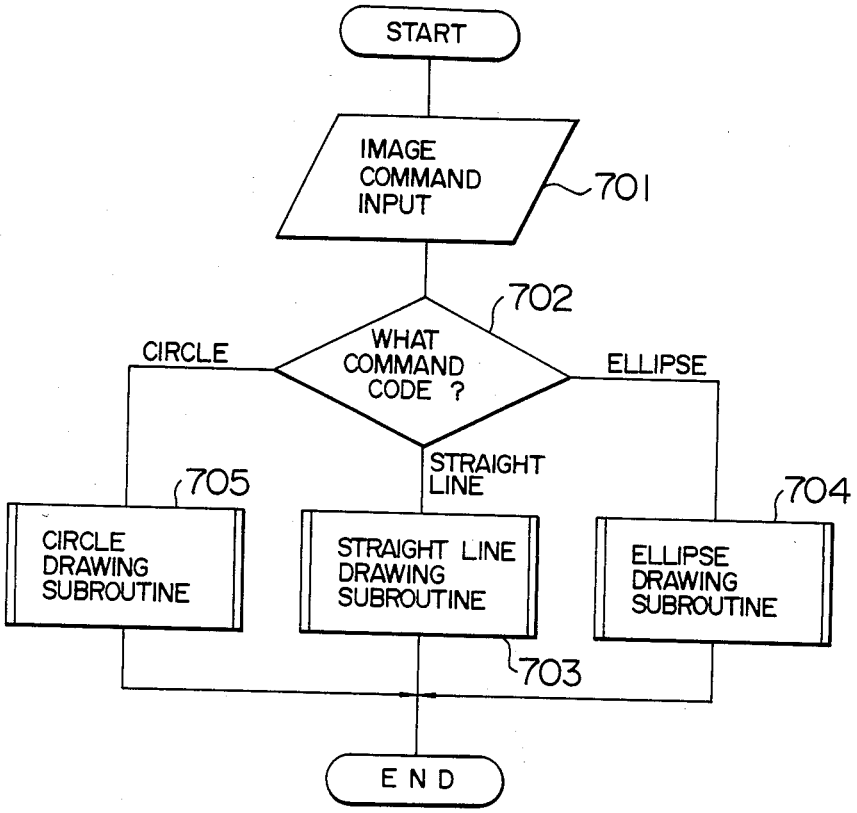
FIG. 7 is a flow chart showing the procedure for the drawing of images by using the display device illustrated in FIG. 4.

Next, the whole procedure for drawing an image on the display device indicated in FIG. 4 will be explained, by referring to FIG. 7.

At first, in Step 701, an image command indicating the nature of the image to be drawn is inputted, which command is produced by pushing either one of the keys 205, 206 and 207. However, this image command is not limited to those inputted by the keys 205–207 pushed by the operator, but for example, the program can be so modified that the image command is spontaneously produced as an execution command for the program in the course of the execution of the program carried out in the drawing device. Next, in Step 702, the command code of the inputted image command is identified and the command is directed to the straight line drawing subroutine (Step 703), the ellipse drawing subroutine (Step 704) or the circle drawing subroutine (Step 705), depending on the value of the code.

Figure 8:
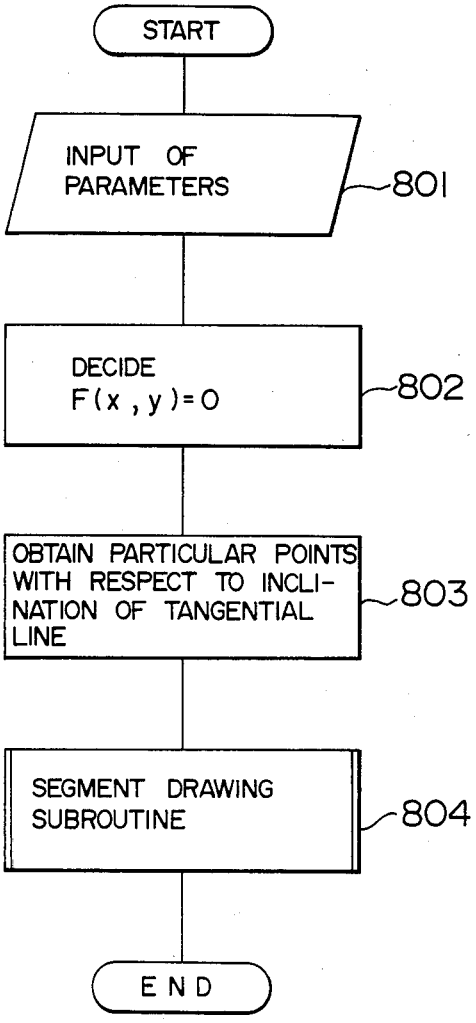
FIG. 8 is a flow chart showing a subroutine procedure for drawing each of the images in the flow chart in FIG. 7.

Any of the drawing subroutines in Steps 703, 704 and 705 effects similar treatment, the general flow of which is indicated in FIG. 8. In FIG. 8, the parameters of the image to be drawn (e.g. for an ellipse, the position of the center, the length of the major axis, the length of the minor axis, etc. of the ellipse in the image output region or on the display screen) are inputted in Step 801. In the display device indicated in FIG. 4, the parameters of the image are inputted by the operator, specifying them by the shift of the cursor, but just as for the input of the image command, the program can be so modified that the parameters of the image are produced as an execution command for the program in the course of the execution of the program carried out in the drawing device.

Next, in Step 802, a function $F(x, y)=0$ representing the image to be drawn is determined on the basis of the parameters of the image inputted in Step 801. Further, in Step 803, coordinates (X, Y) are obtained for particular points having particular inclinations (e.g. points, where the tangent of the tangential line is equal to $+1$ or $-1$) among inclinations of the tangential line at each point of the image by using the function representing the image and stored in a register. In Step 804, the straight line drawing subroutine is carried out by using the coordinates (X, Y) of these particular points.

Figure 9:
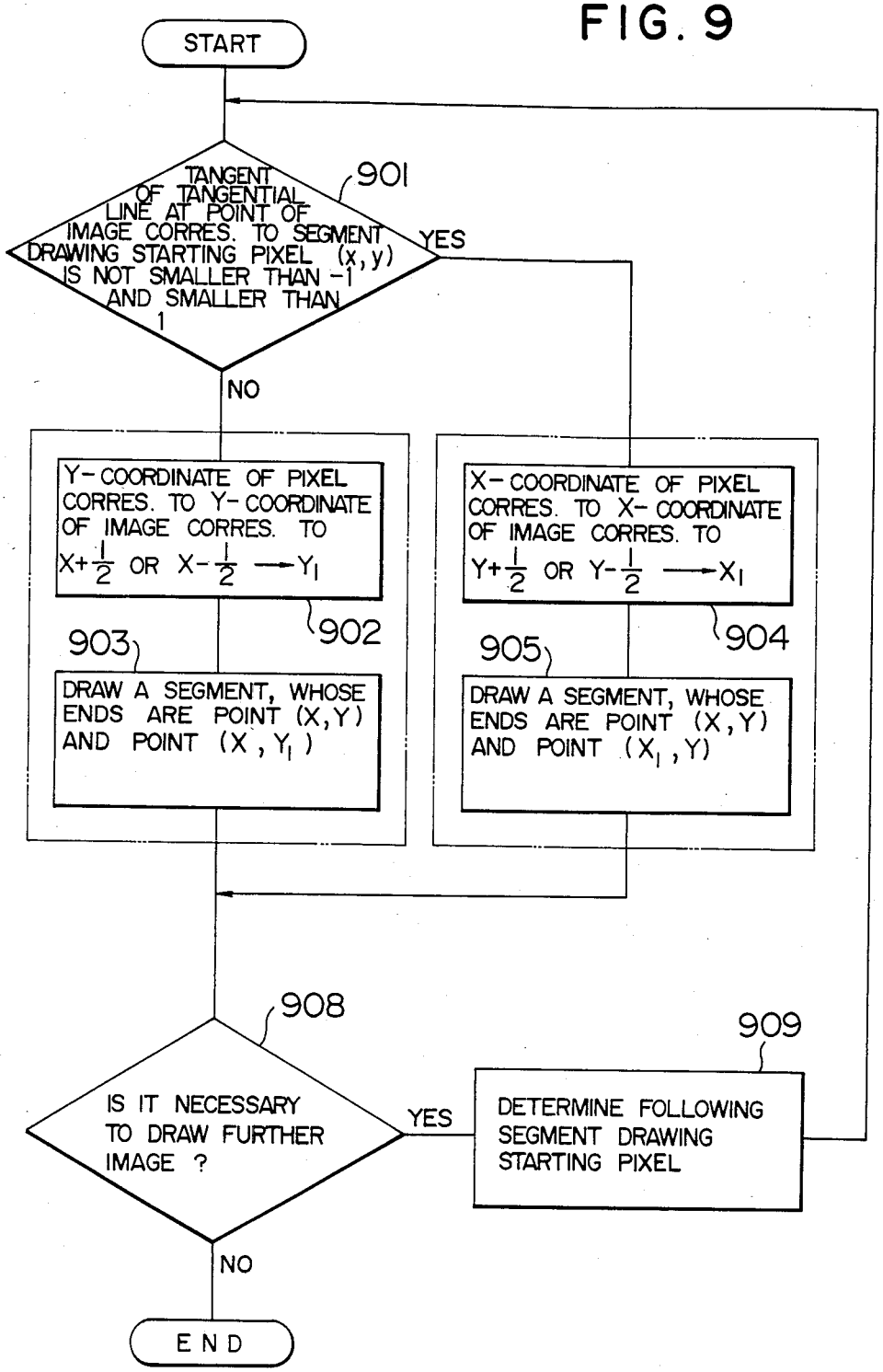
FIG. 9 is a flow chart showing a subroutine procedure for drawing segments in the flow chart in FIG. 7.

FIG. 9 shows the general aspect of the treatment according to the straight line drawing subroutine. In Step 901, it is judged if the tangent of the tangential line at the point corresponding to the segment drawing starting pixel (which is the drawing starting pixel of the image for the first segment to be drawn) is greater or smaller than the particular tangents (in this example $\pm 1$). In practice, if the coordinates (X, Y) of the particular points obtained referring to FIG. 8 are known, it is not necessary to examine the tangent of the tangential line at all the points of the image to be drawn, because every point of the image between the particular points has the same relation with respect to the comparison of the tangent as at one of the particular points.

If, in Step 901, the tangent $\alpha$ of the tangential line at a point of the image is $-1 \leqq \alpha < 1$, proceed to Step 904, where the length of a segment to be drawn in the direction parallel to the X-axis, seen on the image output region or the display screen, (i.e. the number of pixels constituting the segment) is determined. In this embodiment, since it is supposed that the interval between the pixels is equal to 1, in Step 904, when the image is drawn in a direction that the Y-coordinate of the image is increased, a straight line parallel to the X-axis and passing through a point $(0, Y+\frac{1}{2})$ is chosen as an auxiliary line for determining the length of the segment and when the image is drawn in a direction that the Y-coordinate of the image is decreased, a straight line parallel to the X-axis and passing through a point $(0, Y-\frac{1}{2})$ is chosen as an auxiliary line. The intersection of one of these straight lines parallel to the X-axis with the image to be drawn is calculated and the value $X_1$ of the X-coordinate of the pixel, which doesn't exceed the X-coordinate of the intersection and is the closest to it, is obtained, because the coordinates (X, Y) of the pixels constituting the pixel matrix are not continuous but separate from each other.

In this way, the length of the segment extending from the segment drawing starting pixel, which is at the coordinates (X, Y), to the segment drawing ending pixel, which is at the coordinates $(X_1, Y)$ in the direction parallel to the X-axis is determined and in Step 905, the segment is drawn. In practice, the CPU 604 in FIG. 6 transmits image data indicating pixels constituting the segment to be drawn (i.e., pixels to be illuminated on the display screen) to a bit map processor 620. Another bit map processor 620 receives this image data and writes a determined bit, e.g. "1", in a corresponding memory cell position of an image screen buffer 612. A video control device 621 reads-out the data in the image screen buffer 612 at a high speed and drives a CRT 606 according to the data thus read-out. In this way, an image corresponding to the content of the image screen buffer 612 is displayed on the display screen.

If, in Step 901, the tangent $\alpha$ of the tangential line at the point of the image is $\alpha < -1$ or $1 \leqq \alpha$, proceed to Step 902, where the length of a segment to be drawn in the direction parallel to the Y-axis, seen on the image output region or the display screen, is determined in the same way as in Step 904. However, in Step 902, if the image is drawn in a direction that the X-coordinate of the image is increased, a straight line parallel to the Y-axis and passing through a point $(X+\frac{1}{2}, 0)$ is chosen as an auxiliary line for determining the length of the segment and if the image is drawn in a direction that the X-coordinate of the image is decreased, a straight line parallel to the Y-axis and passing through a point $(X-\frac{1}{2}, 0)$ is chosen as an auxiliary line. By using the intersection of one of these straight lines parallel to the Y-axis with the image to the drawn, the value $Y_1$ of the Y-coordinate of the pixel, which doesn't exceed the Y-coordinate of the intersection and is closest to it, is obtained.

In Step 903, a segment extending from the segment drawing starting pixel (X, Y) to the segment drawing ending pixel $(X, Y_1)$ in the direction parallel to the Y-axis is drawn.

When the drawing of the segment is terminated is Step 903 or 905, it is judged if it is necessary to continue to draw the image or not. More particularly, it is determined if the segment drawing ending pixel of the segment, which has been drawn in Step 903 or 905, is the drawing ending pixel of the image. If it is necessary to continue to draw the image, proceed to Step 909, where the segment drawing starting pixel of the following segment to be drawn is chosen. For example, when the tangent or inclination $\alpha$ of the tangential line of the image described above is $0 < \alpha < \pi/2$ and the image is drawn in a direction that its X-coordinate is increased (that is, its Y-coordinate is also increased), supposing that the coordinates of the segment drawing ending pixel of the segment, which have been determined immediately before are $(X_e, Y_e)$ and that the interval between the pixels in the directions of the X- and Y-axes is 1, the pixel whose coordinates are $(X_e+1, Y_e+1)$ is the segment drawing starting pixel of the following segment to be drawn. In the same way, when $-\pi/2 < \alpha < 0$ and the image is drawn in a direction that its X-coordinate is increased (that is, its Y-coordinate is decreased), the pixel at the coordinates $(X_e+1, Y_e-1)$ is the segment drawing starting pixel of the following segment to be drawn.

After having repeated segment drawings in this way, when it is judged in Step 908 that it is no longer necessary to draw the image, the drawing of the image is terminated.

A method for drawing $\frac{1}{4}$ of an ellipse will be explained below more in detail, referring to FIG. 10 to FIG. 13. When $\frac{1}{4}$ of an ellipse is drawn, it is evident that it is possible to draw a whole ellipse by rotating the partial curve and turning it upside down in a suitable manner.

Figure 10:
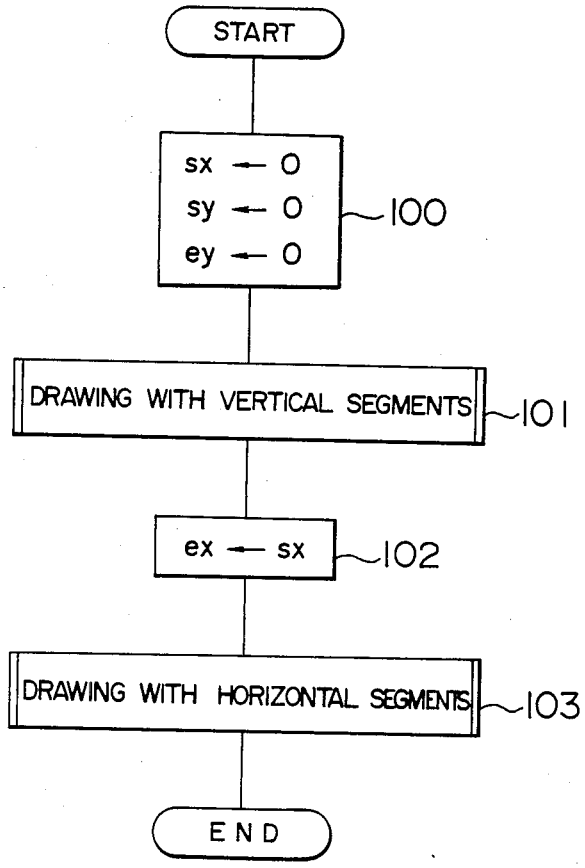
FIG. 10 is a flow chart showing a subroutine procedure for drawing segments constituting an ellipse.
Figure 13:
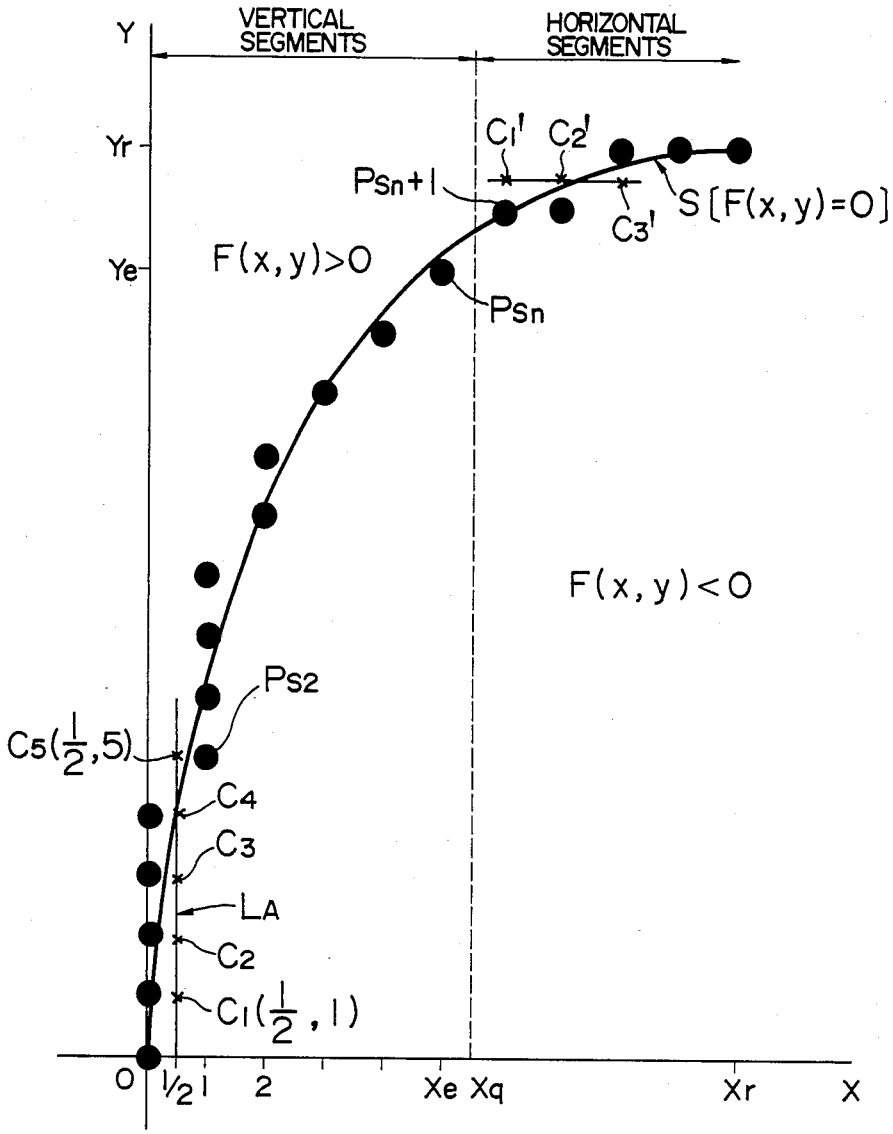
FIG. 13 is a graph for explaining the method for drawing vertical segments, taking an ellipse as an example, according to this invention.

FIG. 10 is a flow chart showing the whole treatment for drawing $\frac{1}{4}$ of an ellipse S, as indicated in FIG. 13. Suppose that the coordinates of the segment drawing starting pixel are (sx, sy) and that the coordinates of the segment drawing ending pixel are (ex, ey). Since the drawing is started at the origin (0, 0) in FIG. 13, 0 is set at registers corresponding to sx, sy in Step 100. Futher, since the drawing begins with the length of the segment (i.e. the number of pixels) equal to the length of a single pixel (i.e. 1), 0, which is the same value as sy, is set at a register corresponding to ey. In FIG. 13, the X-coordinate Xq of a particular point, where the tangent $\alpha$ of the tangential line of the ellipse S to be drawn is 1, can be obtained by using a function representing the ellipse S. Consequently, the part of the image in the region $0 \leqq x < Xq$ is drawn with a set of vertical segments in Step 101. When the drawing in Step 101 is terminated, the values of the segment drawing ending pixel are initialized in Step 102 in order to prepare for the drawing of segments in the horizontal direction. After that, in Step 103, the part of the image in the region $Xq \leqq x < Xr$ (i.e., the region $Yq \leqq y < Yr$) is drawn with a set of horizontal segments.

Figure 3A:
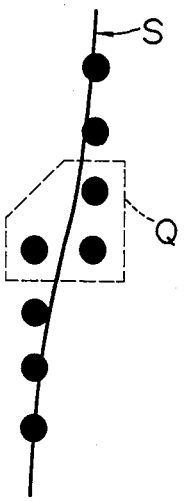
FIG. 3A PRIOR ART
FIG. 3A is a schematic diagram for explaining problematical points in an image drawn according to the prior art method.
Figure 3B:
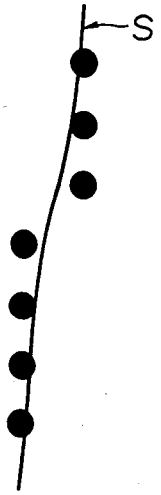
FIG. 3B is a schematic diagram illustrating an example of images drawn to appear visually more naturally.
Figure 11:
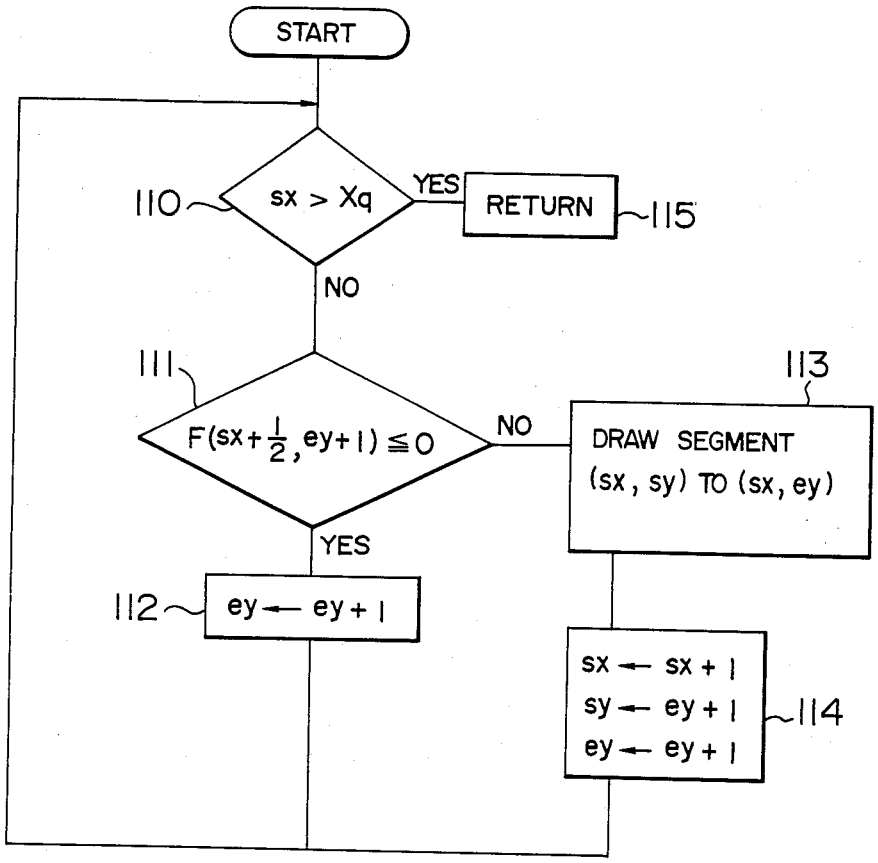
FIG. 11 is a flow chart showing the procedure for drawing vertical segments in the flow chart in FIG. 10.

FIG. 11 shows the segment drawing subroutine treatment of the vertical segments in FIG. 10 in detail. In FIG. 13, the coordinates of the first segment drawing starting pixel are (0, 0). Consequently, a condition $sx < Xq$ is valid. Thus the judgment in Step 110 is "NO" and the procedure proceeds to Step 111. In Step 111, considering a point $C_1$, whose coordinates are ($\frac{1}{2}$, 1), advanced from the segment drawing starting pixel in the positive direction along the X-axis by $\frac{1}{2}$ of the interval between the pixels ($\frac{1}{2}$ in this case) and in the positive direction along the Y-axis by +1, it is judged if this point $C_1$ has traversed the image of the ellipse S or not. This judgment can be effected by substituting the values of the coordinates of the point $C_1$ for x and y in the function F(x, y) representing the image and examining if $F(\frac{1}{2}, 1) \leqq 0$ is valid. Since $F(\frac{1}{2}, 1) < 0$ is valid in Step 111, the procedure proceeds to Step 112 and after having increased ey by +1, returns to Step 110. When the procedure proceeds secondly to Step 111, since ey is increased by +1, it is judged if the point $C_2(\frac{1}{2}, 2)$ in FIG. 13 has traversed the image of the ellipse S or not. Similarly to the case of the point $C_1$, since $F(\frac{1}{2}, 2) < 0$ is valid, the procedure proceeds to Step 112 ey is further increased by +1 and returns to step 110. By repeating such a loop for the points from $C_1$ to $C_4$, 4 is set in the register corresponding to ey in Step 112 and the procedure returns to Step 110. Then, the procedure proceeds from Step 110 to Step 111. In Step 111, it is judged if the point $C_5(\frac{1}{2}, 5)$ has traversed the image of the ellipse S or not. Since $F(\frac{1}{2}, 5) > 0$, the procedure proceeds to Step 113, where a segment extending in the vertical direction and having a length from the segment drawing starting point, whose coordinates are (0, 0), to the segment drawing ending point, whose coordinates are (0, 4), is drawn. In practice, as already mentioned, the data showing the pixels constituting the segments are written in the image screen buffer 612 in FIG. 6. When the drawing of the segment is terminated, the procedure proceeds to Step 114. In Step 114, 1, 5 and 5 are set in the registers corresponding to sx, sy and ey, respectively. The pixel $P_{s2}$ of coordinates (1, 5) is the segment drawing starting pixel of the following segment. It is for initializing the values of the segment drawing ending pixel at the moment, where the decision of the length of the segment is begun, that 5, which is the same as for sy, is set in ey. In addition, when the first segment is drawn, it can be seen that the points $C_1$ to $C_5$ are aligned on a straight line LA parallel to the Y-axis and passing through a point of coordinates (0, $\frac{1}{2}$) (which can be called an auxiliary line for determining the length of the segment). Further, since the segment drawing starting pixel $P_{s2}$ of the following segment is shifted by 1 interval between the pixels both in the direction of the X-axis and in the direction of the Y-axis with respect to the segment drawing ending pixel of the preceding segment, the arrangement of pixels as illustrated in FIG. 3B can be realized. That is, according to this invention, illuminated pixels are never arranged in such a manner that they give a visually unnatural expression, as indicated in FIG. 3A. When the drawing of the segments $P_{sn}$ in FIG. 13 by repeating the drawing of vertical segments as mentioned above (Step 113 in FIG. 11) is terminated, the procedure returns through Step 114 to Step 110. At this moment, since $sx > Xq$, the segment drawing subroutine for the vertical segments is terminated.

Figure 12:
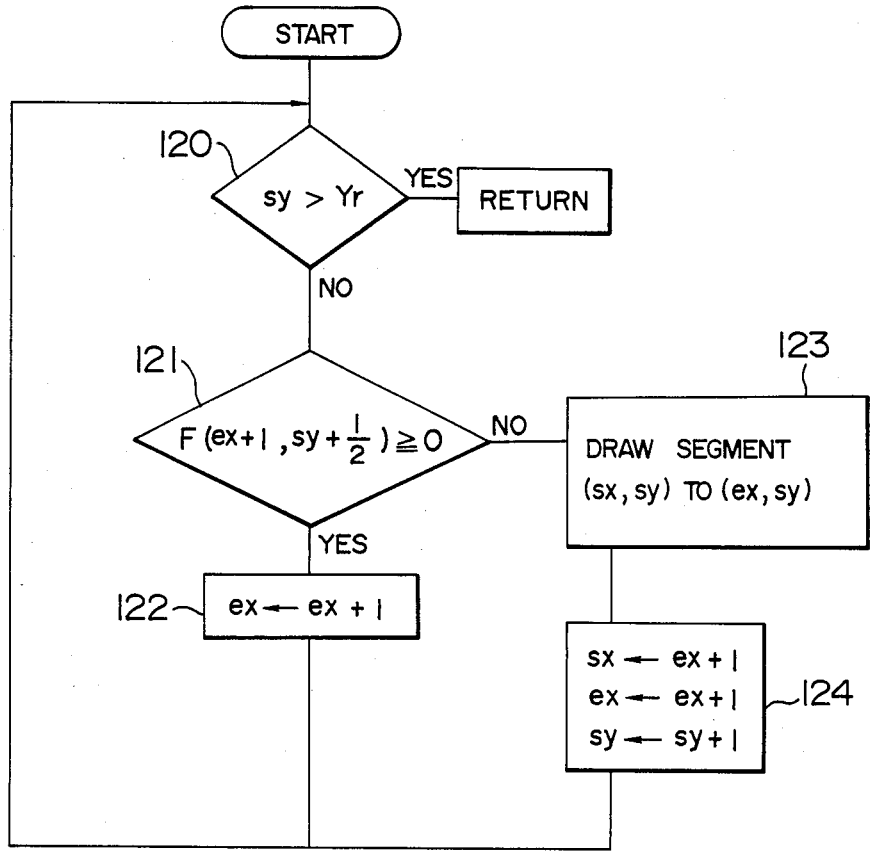
FIG. 12 is a flow chart showing the procedure for drawing horizontal segments in the flow chart in FIG. 10.

FIG. 12 shows the segment drawing subroutine for horizontal segments in FIG. 10 in detail. Steps 120, 121, . . . , 124 in FIG. 12 correspond to Steps 110, 111, . . . , 114, respectively. This subroutine differs from that for vertical segments only in that $F(ex+1, sy+\frac{1}{2}) \geqq 0$ is used for the judgment in Step 121 and that the Y-coordinate of the segment drawing ending pixel is $Y_r$. For the other parts only the X-axis and the Y-axis are interchanged by each other and the explanation of the treatment in FIG. 12 can be easily inferred from the explanation for FIG. 11. Consequently it is omitted.

Figure 14:
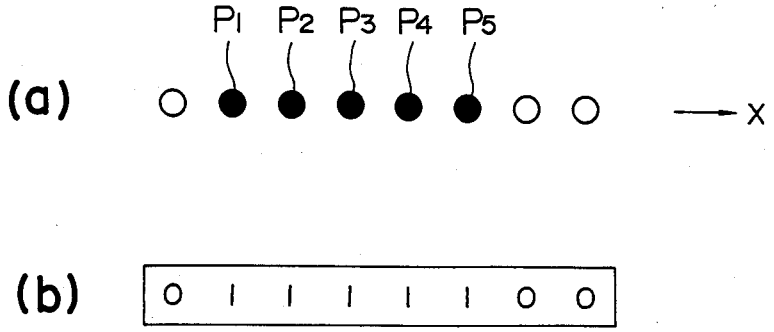
FIGS. 14A and 14B are a scheme for explaining a write-in operation for image data indicating pixels to be drawn to an image buffer.

In this way, the image to be drawn is drawn only with vertical and horizontal segments. Since the direction of each of the segments is automatically determined by using the inclination of the tangential line at each point of the image to be drawn and no complicated calculations are necessary for the determination of pixels to be illuminated, the drawing can be effected at a high speed. In addition, since the pixel data indicating the pixels to be illuminated is written all together in the image screen buffer, after the length of the segment (i.e. the number of pixels constituting the segment) has been determined, when the image screen buffer is constructed so as to be matched therewith, it is possible to write data at a still higher speed. For example, if the buffer 612 (in FIG. 6) is so constructed that 8 pixels are written by one operation for pixels aligned on one horizontal line, when pixel data representing a segment constituted by the pixels $P_1$–$P_5$ as indicated by (a) in FIGS. 14A and 14B are written in the image screen buffer, writing is terminated by one access to the image screen buffer 612 with 1 byte data such as "01111100" indicated by FIG. 14B. Since, according to the prior art method, writing of pixel data was effected always for data of every pixel, speed-up can be obtained in this respect by the method according to this invention.

Figure 15A:
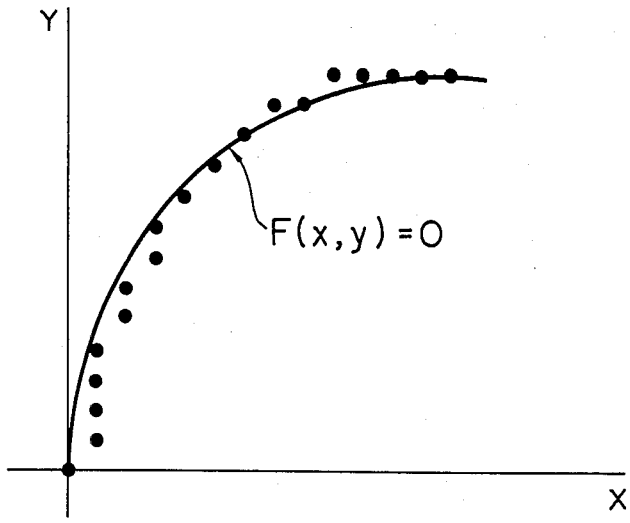
FIGS. 15A and 15B indicate graphs showing examples of images drawn according to the image drawing method of this invention.
Figure 15B:
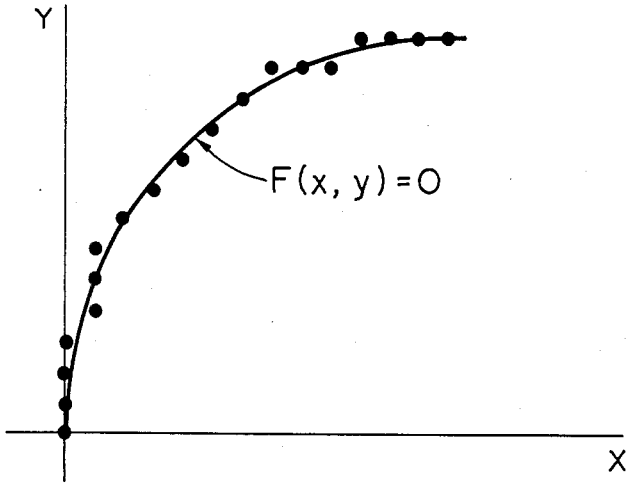

According to this invention, the determination of segments is effected by using an auxiliary line, which is shifted by $\frac{1}{2}$ of the interval between the pixels in the direction of the X-axis or the Y-axis with respect to the coordinates of the actual pixel. However, according to a simplified method of this invention, it is also possible to conceive another method for determining the length of the segment by judging if the coordinates of pixels themselves constituting the segment traverse the image to be drawn or not. An example, in which $\frac{1}{4}$ of a circle is drawn according to such a simplified method, is illustrated in FIG. 15A. It can be understood that FIG. 15B represents the features of the circle visually better, when FIG. 15A is compared with FIG. 15B, in which the same $\frac{1}{4}$ of a circle is drawn by using an auxiliary line according to this invention.

Figure 16:
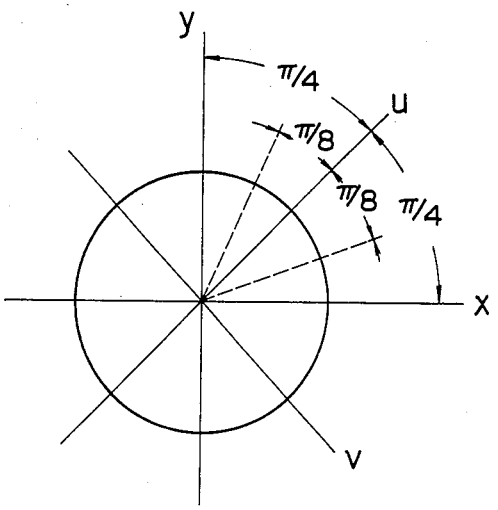
FIG. 16 is a graph showing a variation of the image drawing method according to this invention.

Although, in the embodiments described above, only cases, where the produced segments are parallel to the X-axis or the Y-axis, are shown, this invention is not limited thereto, but it is also possible to form a more smooth curve consisting of a plurality of different types of segments previously determined. For example, it is useful in practice to adopt 4 directions (x, y, u, v) obtained by adding 2 directions forming 45° with the X-axis and the Y-axis thereto, as indicated by u and v in FIG. 16. In this case, the boundaries for classifying dy/dx are set for every $\pi/8$ rad, as indicated in the figure.

Although, in the embodiments described above, a CTR display device is used as an image output device, it is clear that a dot matrix type plasma display or a display using light emitting diodes, EL or LCD can be also used as well. Further, as the image output device, those which print outputs on a printed medium, such as an X-Y plotter, can be also used for realizing this invention.

We claim:

1. A method for drawing a desired image in an image output region comprising a plurality of separate pixels arrayed in two orthogonal directions, comprising the steps of:

(a) obtaining parameters for the desired image to be drawn to determine a function thereof;

(b) calculating the inclination of a tangential line at a position of said desired image corresponding to a position of a starting pixel from which a segment should be started;

(c) selecting a line of pixels along a direction determined on the basis of said inclination;

(d) determining an auxiliary line which is disposed in parallel to the selected pixel line;

(e) determining a number of pixels in the selected pixel line so as to form a segment whose length is determined at an intersection of said auxiliary line with said desired image; and (f) outputting said desired image in said image output region with segments obtained by repeating the above steps (b) to (e).

2. An image drawing method according to claim 1, wherein in the step (e), the number of pixels forming said segment is incremented so as to extend the length of said segment while said auxiliary line extending toward said desired image does not intersect said desired image, and a starting pixel of a next segment is determined when said auxiliary line intersects said desired image.

3. An image drawing method according to claim 1, wherein said orthogonal directions are X-axis and Y-axis directions in an orthogonal X-Y coordinate system, if the tangent of a tangential line at a point of said desired image corresponding to a starting pixel of a segment is greater than 1 or not greater than $-1$, the segment and said auxiliary line are extended along the Y-axis direction, and if the tangent of a tangential line at a point of said desired image corresponding to a starting pixel of a segment is greater than $-1$ and not greater than 1, the segment and said auxiliary line are extended along the X-axis direction.

4. An image drawing method according to claim 1, wherein said auxiliary line is shifted by $\frac{1}{2}$ of an interval between the adjoining pixels from a position of the starting pixel of a corresponding segment and extended toward said desired image along the direction of the corresponding segment.

5. An image drawing method according to claim 3, wherein the position of an ending pixel of a segment is spaced from a starting pixel of a next segment by an interval of pixels in the X-axis direction and by an interval of pixels in the Y-axis direction, so long as there exists another segment to be drawn.

6. An image drawing device comprising:

an image display device having an image output region including a plurality of pixels arranged in an orthogonal X-Y matrix form;

means, including an image screen buffer having a plurality of memory cell locations, each of which corresponds to a respective pixel in said image output region, for reaching out the content of said image screen buffer to transfer the content to said image display device;

a plurality of registers for storing parameters required to draw a desired image;

memory means for storing at least a program of a drawing procedure; and processor means connected to said image screen buffer, said register and said memory means, for executing said program by calculating the tangent of a tangential line at a position of said desired image corresponding to a position of a starting pixel from which a segment should be started; selecting a line of pixels along one of X-axis and Y-axis direction determined on the basis of the inclination indicated by said calculated tangent; determining an auxiliary line in parallel with the selected pixel line; determining a number of pixels in the selected pixel line so as to form a segment whose length is determined at an intersection of said auxiliary line with said desired image; writing image data of a plurality of segments thus obtained in said image screen buffer; and drawing said plurality of segments on said image display device on the basis of the image data as an approximation of said desired image.

* * * * *